United States Patent [19]

Straffi

[11] 4,128,221

[45] Dec. 5, 1978

[54] CONSTRUCTION OF A SUPPORTING GRID FOR PIPES

[75] Inventor: Franco Straffi, Milan, Italy

[73] Assignee: Breda Termomeccanica S.p.A., Milan, Italy

[21] Appl. No.: 668,963

[22] Filed: Mar. 22, 1976

[30] Foreign Application Priority Data

Oct. 17, 1975 [IT] Italy ..... 28382 A/75

[51] Int. Cl.[2] ..... F28F 9/00

[52] U.S. Cl. ..... 248/68 R; 165/74; 165/82; 165/162

[58] Field of Search ..... 165/72, 73, 74, 75, 165/162, 82; 52/664, 666, 668; 248/68 R; 122/510; 176/78; 403/242

[56] References Cited

U.S. PATENT DOCUMENTS

| | | | |
|---|---|---|---|
| B 488,836 | 3/1976 | Berger et al. | 165/162 |
| 1,274,342 | 7/1918 | Smith | 122/510 X |
| 1,684,027 | 9/1928 | Hinman | 49/48 X |
| 1,780,294 | 11/1930 | Davis | 165/82 |
| 1,832,311 | 11/1931 | Lockett et al. | 122/510 |
| 2,256,882 | 9/1941 | Sebald | 165/82 X |
| 2,404,187 | 7/1946 | Millener | 165/75 |
| 3,420,297 | 1/1969 | Romanos | 165/162 |
| 3,503,440 | 3/1970 | Romanos | 165/162 |
| 3,545,537 | 12/1970 | Hill | 165/162 |
| 3,575,236 | 4/1971 | Romanos | 165/162 |
| 3,719,560 | 3/1973 | Mayers et al. | 176/78 |
| 3,867,047 | 2/1975 | Wightman et al. | 403/242 |
| 3,907,031 | 9/1975 | Tegethoff | 165/162 |
| 3,937,277 | 2/1976 | Krolmann et al. | 165/162 |
| 3,941,188 | 3/1976 | Scheidl | 165/162 |
| 4,036,461 | 7/1977 | Soligno | 165/162 X |

FOREIGN PATENT DOCUMENTS

| | | |
|---|---|---|
| 2035011 | 2/1971 | Fed. Rep. of Germany. |
| 1751179 | 12/1971 | Fed. Rep. of Germany. |
| 2262621 | 7/1974 | Fed. Rep. of Germany. |
| 2263056 | 7/1974 | Fed. Rep. of Germany. |

*Primary Examiner*—Rodney M. Bonck
*Attorney, Agent, or Firm*—Fleit & Jacobson

[57] ABSTRACT

A supporting grid for pipes comprising a frame and a reticular structure made of different materials having different thermal expansions, wherein a manhole and associated cover are provided, wherein said cover is made with the same material as the reticular structure and is secured to it, and wherein one or more connections are provided between said cover and said frame for preventing only tangential movements relative to the frame, while one or more connections are provided for preventing only movements perpendicular to the grid surface, enabling all these connections free thermal expansion of said reticular structure and said cover relative to said frame.

9 Claims, 15 Drawing Figures

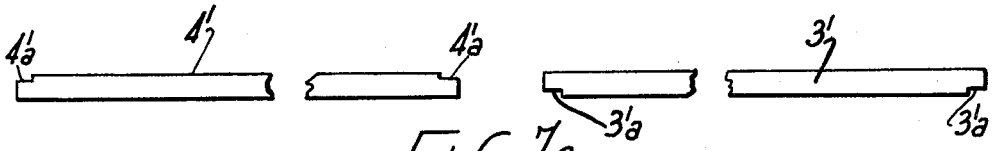
FIG. 7a
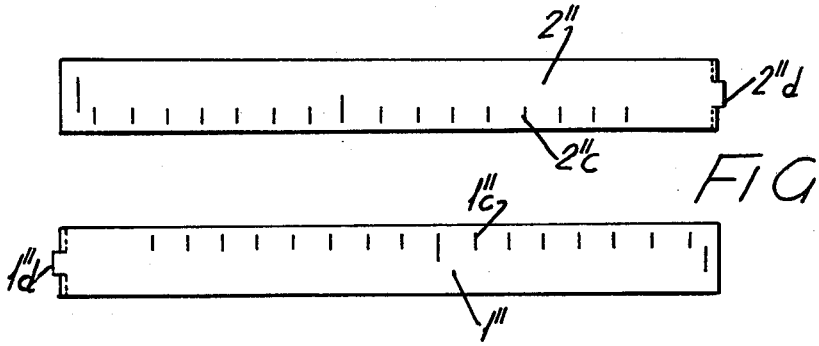
FIG 7b
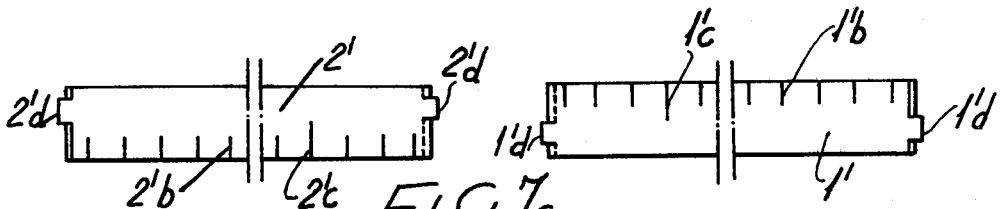
FIG. 7c
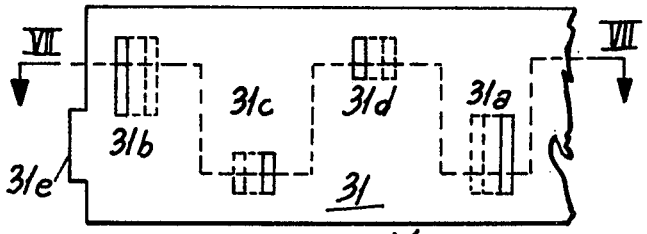
FIG. 7d
FIG 7e
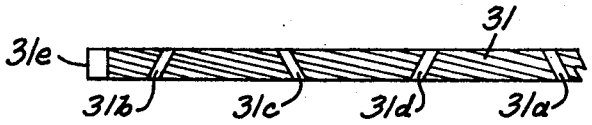

CONSTRUCTION OF A SUPPORTING GRID FOR PIPES

In U.S. patent application Ser. No. 624,475 filed by Vincenzo Soligno on Oct. 21, 1975 for Supporting Grid For Pipes which is assigned to the same assignee and incorporated herein by reference thereto, a grid was described and shown of the type as normally used heat exchangers or the like for supporting the pipes. Said grid comprises primary and secondary strips intersecting to form a support for said pipes, said strips forming the reticular structure of the grid being made of stainless steel or in any case of a material different from that of which the grid frame is formed, usually this latter material comprising carbon steel. The joint between said frame and strips is carried out so as to allow differential thermic expansion of the two materials forming said reticular structure and frame.

A manhole and associated cover were also referred to in the above mentioned patent application. The manhole, which is placed at a peripheral location in the grid, serves the purpose of enabling a man to pass from one side of the grid to the other for facilitating the installation of tubing until this operation, which is carried out from the opposite end of the grid, reaches the manhole. At this point, said manhole is closed by a cover and tubing is blindly terminated, with a resulting greater difficulty than formerly.

Additionally, the provision of a manhole in each of the supporting grids makes both grid surfaces accessible even when the grids are assembled in a heat exchanger. When, said grids are assembled in a heat exchanger, for example from six to nine grids, if a manhole is not provided in each grid, these have to be assembled, aligned and welded, that is all of the work on each grid has to be carried out on one side only and terminated before starting to assemble the next grid, since each next grid would obstruct any access to the preceding one.

Moreover, in the absence of manholes and after all of the grids are assembled in a heat exchanger, an inner cleaning thereof, etc., could not be effected.

The construction of the manhole and associated cover should be such as to retain the grid assembly characteristics, so as to allow for expansion of the central reticular structure comprising said strips of stainless steel or other similar material relative to the frame made of another material and at the same time said construction should have a substantial rigidity or strength as required for tubing, transportation, assembling operations, etc.

In grids according to the present invention it was also found desirable to provide a fastening system for each of the grids relative to the housing, in order to prevent any mutual rotation of these parts about the axis of the steam generator. To this end, it was devised according to the present invention to provide at least one antirotating key welded to the external housing which can be accomodated within suitable slots arranged on the frame, so as to form a stop member for non-rotationally securing each of the grid to the external housing. This is required when the housing is to be rotated and is necessary that all of the inner parts carried by the grids rotate therewith.

The invention will now be more particularly described with reference to the accompanying drawings, in which:

FIG. 1 is a view showing a grid including the manhole, but not its associated cover, when said grid is assembled within the generator housing;

FIG. 1*a* is a view showing a grid portion including the manhole cover assembled in position, the reticular structures of FIGS. 1 and 1*a* not corresponding to one another, but merely illustrative;

FIGS. 7*a*, 7*b*, 7*c* and 7*d* are views showing constructive details of the grid cover;

FIG. 7*e* is a sectional view taken along line VII—VII of FIG. 7*d;*

Figure 8:
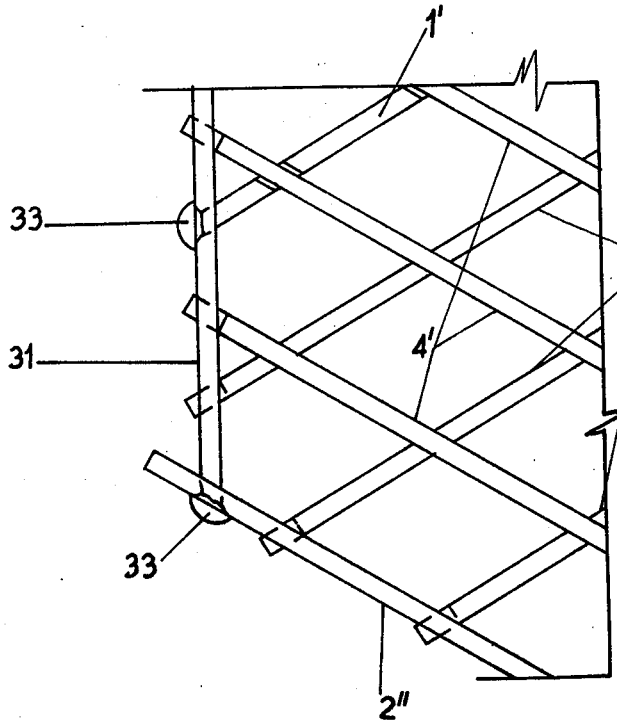

FIG. 8 is a view showing a further detail of the grid cover; and

Figure 9A:
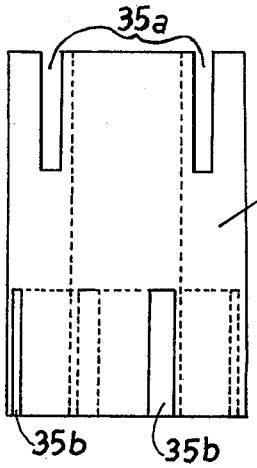
Figure 9B:
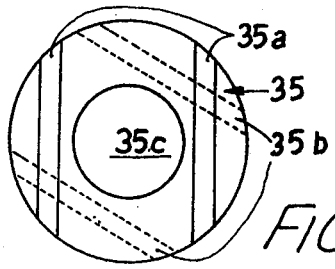

FIGS. 9*a* and 9*b* are side and plan views showing a cover detail, respectively.

Figure 1:
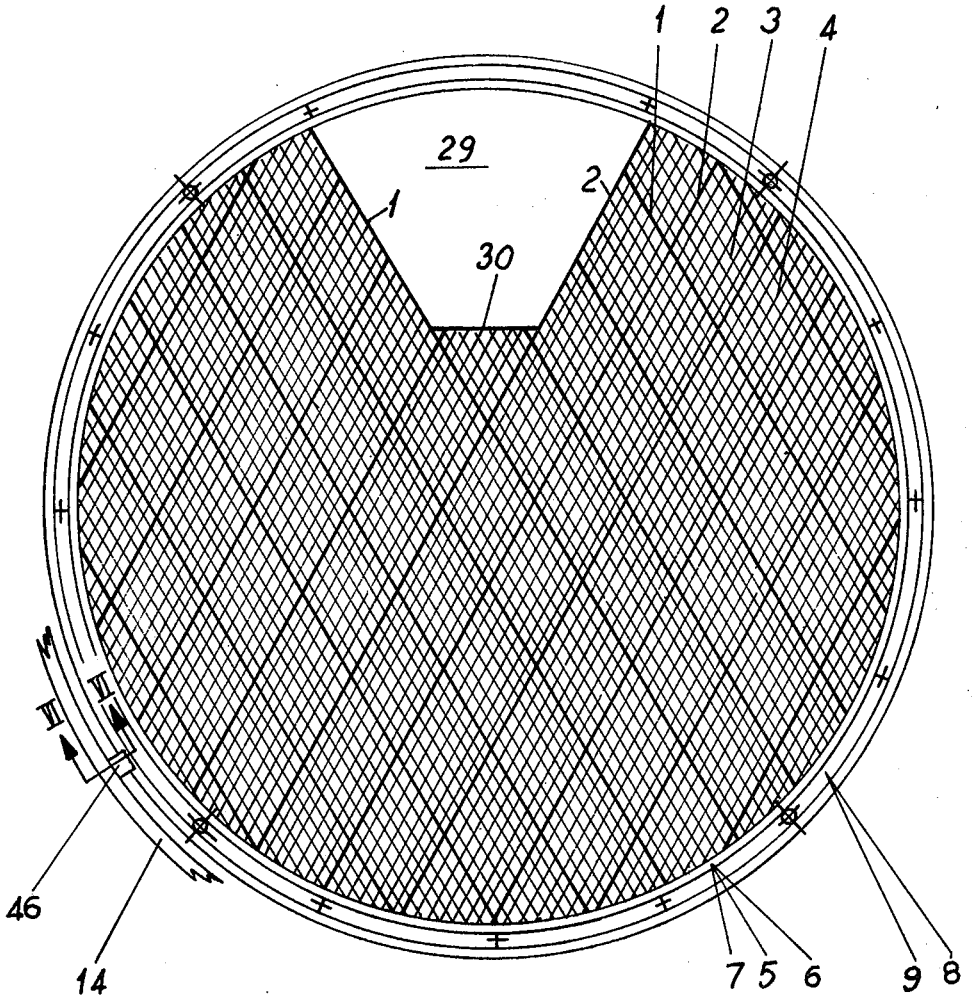

Referring to the accompanying drawings, and particularly to FIG. 1, it will be seen that a grid according to the invention comprises primary strips 1 and 2 and secondary strips 3 and 4, as explained in the above mentioned patent application, all of these strips being retained within a frame comprising rings 8 and 9, spacers 5, 6 and 7 and associated fastening elements. At a peripheral portion of the grid an opening 29 is provided and serves as a manhole, thus permitting passage from one side to the other. This opening or manhole is located at the top during tubing operations, and is limited at the top by a portion of a circle formed by the grid frame, the spacing elements 6 and 7 placed between the strips, which were mentioned in the patent application above referred to, are here replaced by two crown or sector sections 6' and 7' (FIG. 3) having the same length as said portion of circle formed by the grid frame, so as to take the place of said spacing elements 6 and 7 and strip ends penetrating between them. The central part between said sections 6' and 7' further comprises ring 5 which is glued or adhesively attached to the two interconnecting surfaces with such sections 6' and 7'. Additionally, the side ends of sections 6' and 7' are glued or adhesively attached to the associated end strips 1 and 2.

The manhole is laterally defined by two primary strip portions 1 and 2 respectively, and a lower strip 30 (FIG. 1) having the same height as a primary strip. Strip 30 can be secured to the adjoining primary and secondary strips by any known means, such as by riveting, welding or the like, since this strip expands identically as the remainder of the reticular structure.

Figure 1A:
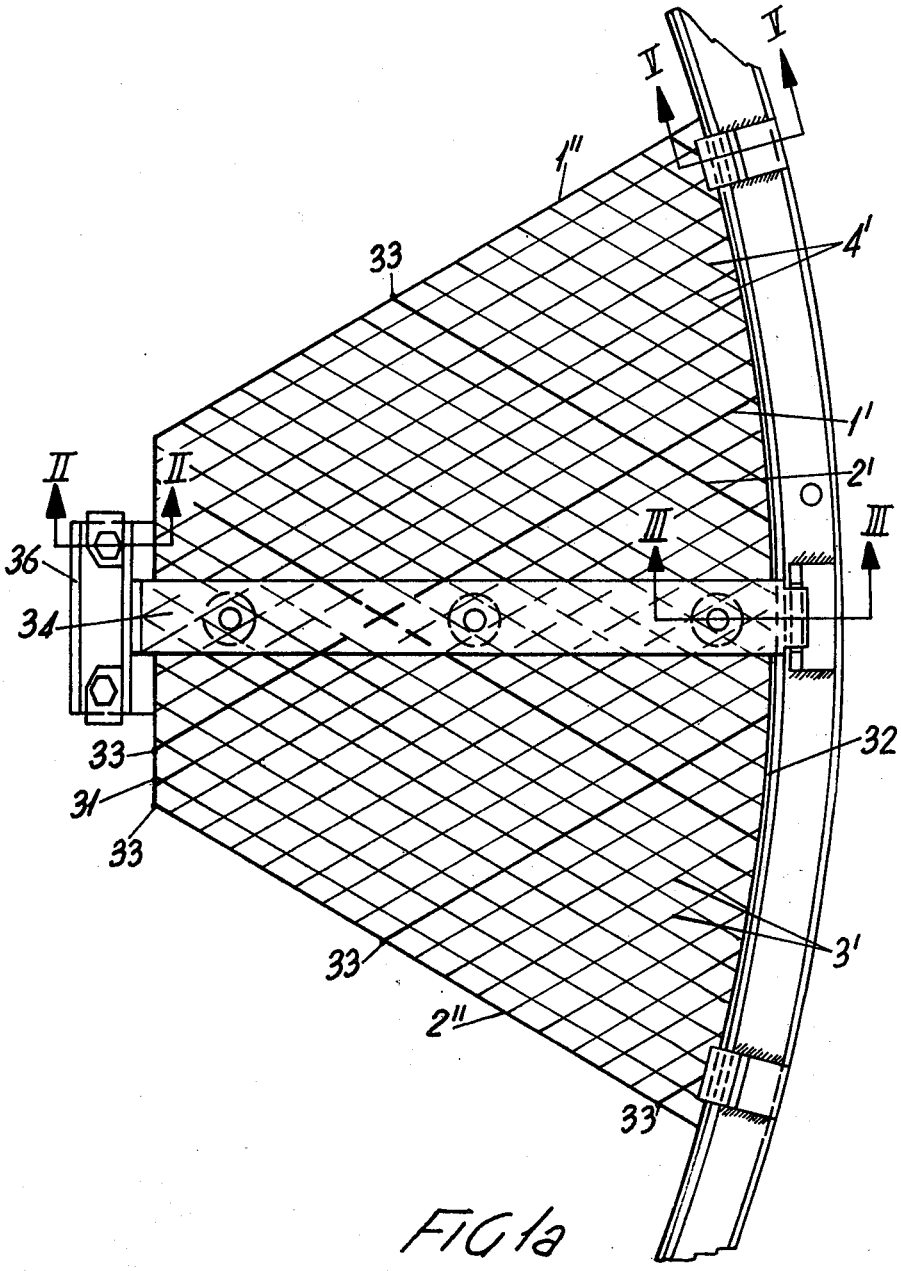

The reticular structure of the manhole cover (FIG. 1*a*) is similar to that of the grid described in the above mentioned patent application and comprises inner primary strips 1' and 2' and secondary strips 3' and 4'.

Primary strips 1' and 2' are shown in FIG. 7*c*. Said strips have main millings or slots 1'*c* and 2'*c* and secondary millings or slots 1'*b* and 2'*b* respectively provided therein, in addition to a side tooth or finger 1'*d* and 2'*d*, respectively, for engaging in the peripheral strips, as hereinafter explained. It should also be noted that these strips are tapered at the ends thereof so as to rest throughout the surface thereof on the peripheral strips 1'', 2'' and 31.

Strips 3' and 4', located within the cover, are different from the preceding strips 3 and 4 comprising the grid, in that the latter are not machined, while strips 3' and 4' are machined at the ends thereof to have a reduced total height, such as shown in FIG. 7*a*, wherein tapered ends 3'*a* and 4'*a*, respectively, can penetrate into corresponding slots 1''*c* and 2''*c* in peripheral strips 1'' and 2'' (FIG. 7*b*). Strip 31 closing the minor fourth side of the manhole cover is shown in FIGS. 7*d* and 7*e* and has main millings or slots 31*a* and 31*b* not perpendicular to the strip, but sloping in a direction for accomodating the ends 1'*d* and 1''*d* of strips 1' and 1'' and in another direction symmetrically at a plane perpendicular to the strip so as to accomodate the ends 2'*d* and 2''*d* of strips 2' and 2''.

The same situation is true for millings or slots 31*c* and 31*d* for respectively accomodating the ends 3'*a* and 4'*a* of strips 3' and 4'. The major curved side of the cover comprises a milled curved strip 32 (FIGS. 1*a* and 5) made of stainless steel, milling operation being carried out according to the same principle on strip 31, that is in accordance with two directions so as to accomodate plates 1', 1'', 2', 2'', 3' and 4'.

By the ends thereof, each of the plates or strips penetrate into the perimetrical strips 1'', 2'', 31 and 32, but to add an increased rigidity to the whole assembly of the cover provision is made for riveting all of the main strips 1', 1'', 2' and 2'' and strips 31 and 32 at the peripheral intersections thereof by means of protecting tabs 1'*d*, 2'*d*, 1''*d*, 2''*d* and 31*e*, as shown on the drawings (FIGS. 7*b*, 7*c* and 7*d*), which for example will be hot riveted on the corresponding plate or strip. This is carried out in all of the above type of intersections, for example as shown at 33 of FIG. 8. All of the above described strips are made of stainless steel, or anyhow made of the same material comprising the reticular structure of the grid.

Figure 3:
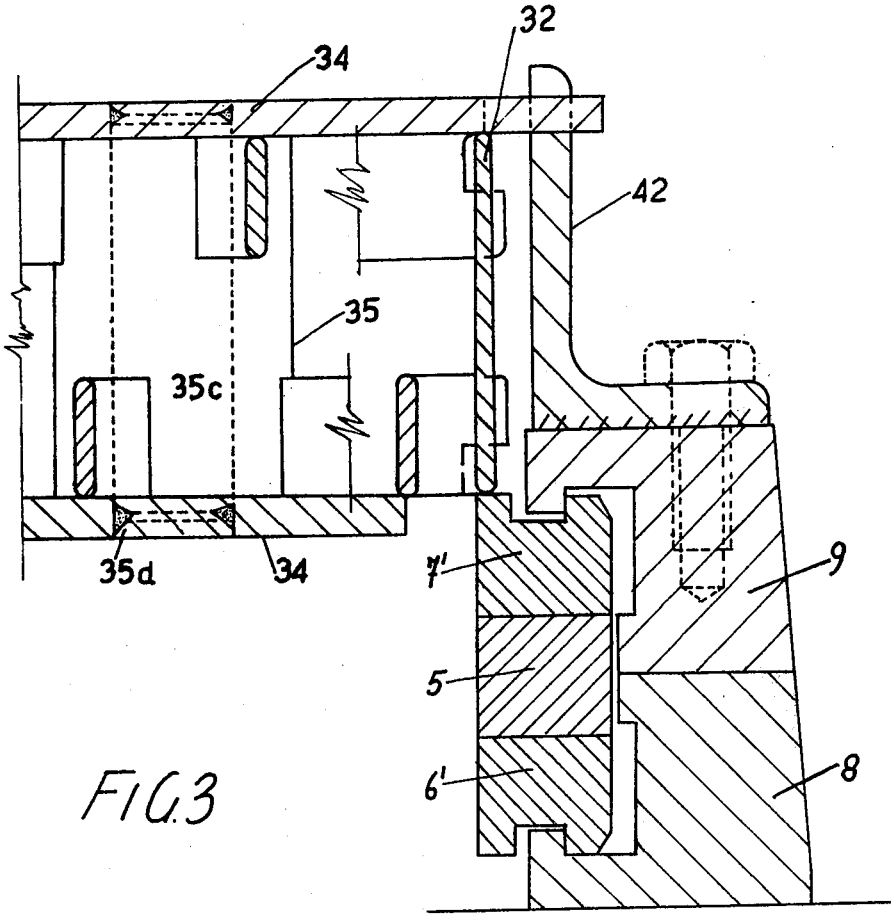
FIG. 3 is a sectional view taken along line III—III of FIG. 1*a;*

The connection between the cover and the grid frame is such that a differential thermic expansion of the cover is allowed relative to the frame, and is carried out as follows. First, two plates 34 have been provided, the plates therebetween comprising bushings 35 as clearly shown in the plan view of FIG. 9*b* and side view of FIG. 9*a*. Said bushings 35 have upper and lower grooves 35*a* and 35*b*, which are offset to one another by as many degrees as the strips 1' are offset relative to the strips 2'. These grooves can snap in secondary strips 3' and 4', thus providing for stiffening. Said bushings 35 have a bore 35*c* therein for the passage of a pin 35*d* that can be made integral with the two plates 34, the latter being thereby interconnected one to another and both to the cover, as shown in FIG. 3.

Figure 2:
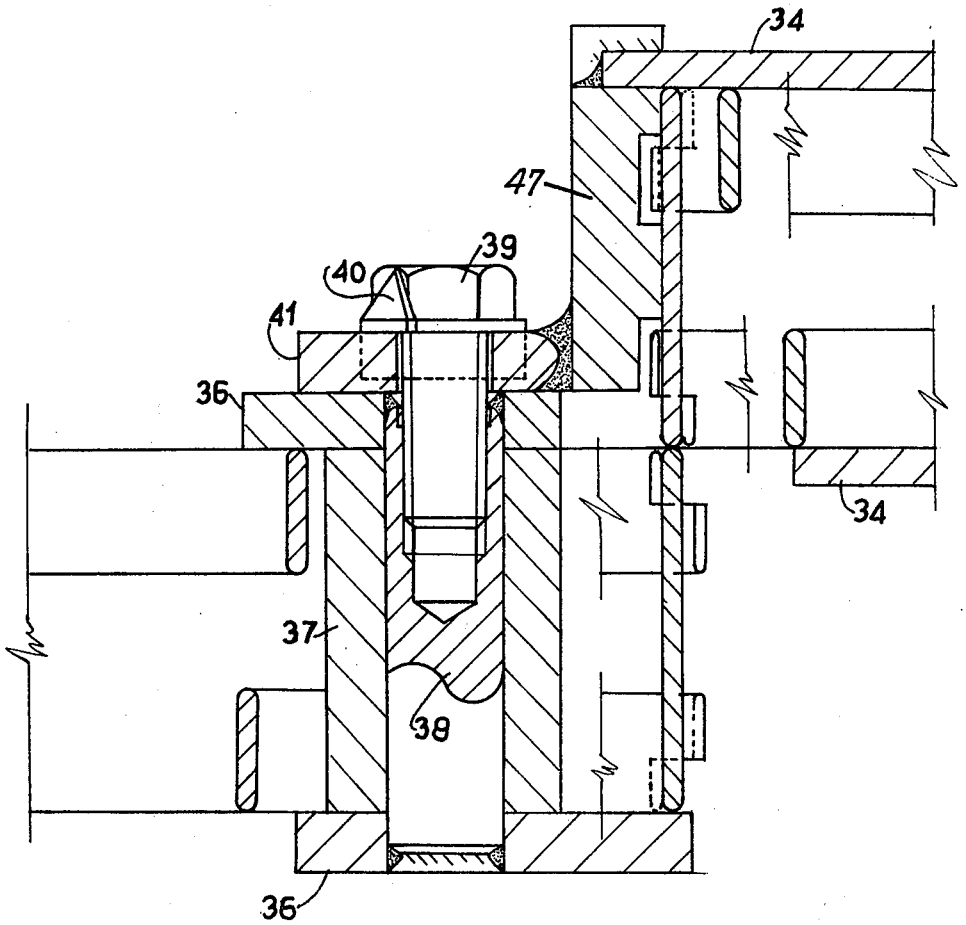
FIG. 2 is a sectional view taken along line II—II of FIG. 1*a;*

These two plates 34 are secured by welding to two similar plates 36 parallel to the former, but arranged on a slightly offset plane. Said plates 36 are secured to each other by comprising a grid portion therebetween (FIG. 2). By a device similar to that above described in connection with plates 34, one or more bushings 37 are inserted between the plates and in the central bore thereof a pin 38 is welded to the two plates 36, so that the latter are clamped relative to the grid. An L-shaped member, comprising two pieces 41 and 47 welded to one another, is bolted to said plates 36 by means of bolts 39 and fixing plates 40. Piece 47, which is arranged perpendicularly of the plane of plates 34 and 36 is also welded to upper plate 34, so as to be integral therewith.

Figure 4:
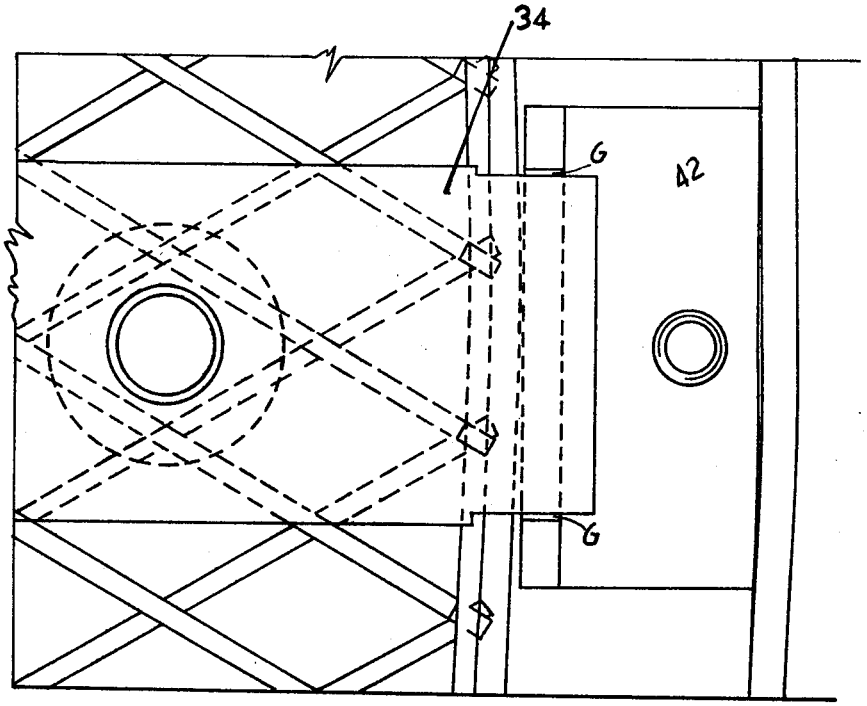
FIG. 4 is a plan view of the detail shown in FIG. 3.
Figure 5:
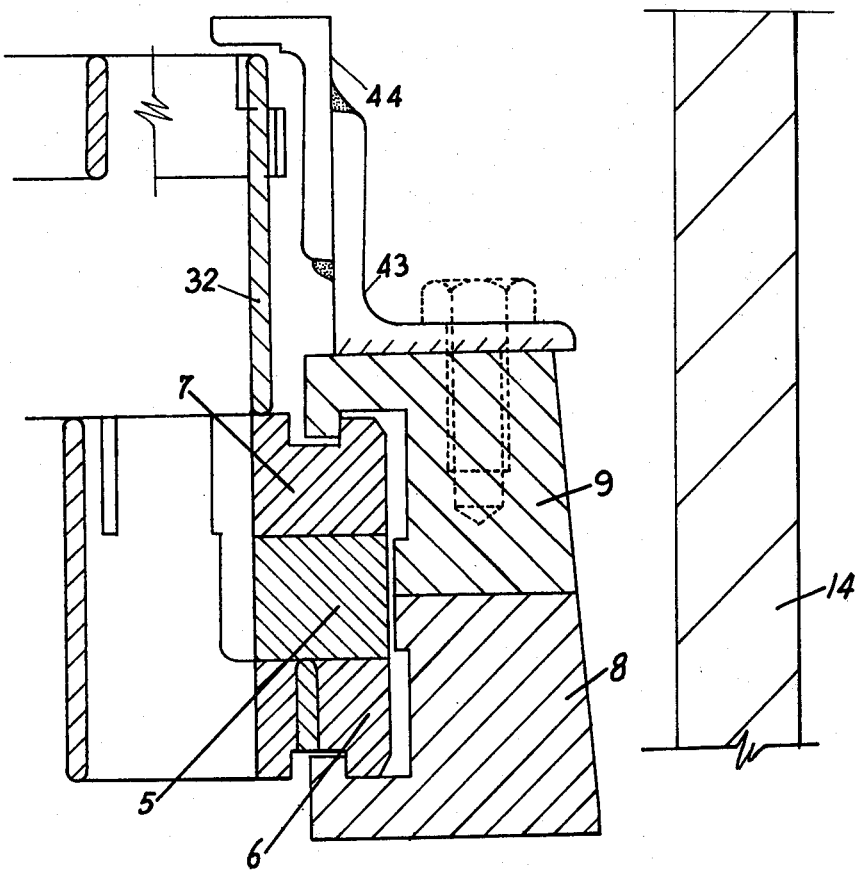
FIG. 5 is a sectional view taken along line V—V of FIG. 1*a;*

This attachment system for the cover, as just herein described, is such that said cover will be completely fixed relative to the remainder of the grid, whereby a connection for the frame should now be provided, allowing the thermic expansion of the inner reticular structure of the grid and cover relative to the frame, the latter being made of a different material expanding differently than the strips. This connection has been carried out as shown in FIGS. 3, 4 and 5. From FIGS. 3 and 4, it will be seen that the outside of the upper plate 34 has been passed within a suitable slit in an L-iron designated by reference numeral 42, which is secured by welding or bolting at a location of the top portion of the frame. The plan view of FIG. 4 shows that said slit in L-iron 42 has a minimal play or clearance relative to the end of plate 34, thus preventing any side movements, while allowing for a radial extension of the plate relative to the frame.

Conversely, through the other two connections at the two ends of the curved portion of the manhole cover, a device is provided for preventing the manhole from being lifted, that is to say to prevent a displacement of the cover perpendicularly of its own plane. This is shown in FIG. 5, wherein it can be seen that an L-iron 43 has been secured on the frame top and has a further L-iron 44 welded thereon to form a "Z"-shaped assembly having a minimal play or clearance in a perpendicular direction to the cover and grid planes, while having a play or clearance of a few millimeters radially of the grid, and this for allowing thermic expansion of the strips relative to the frame.

Figure 6:
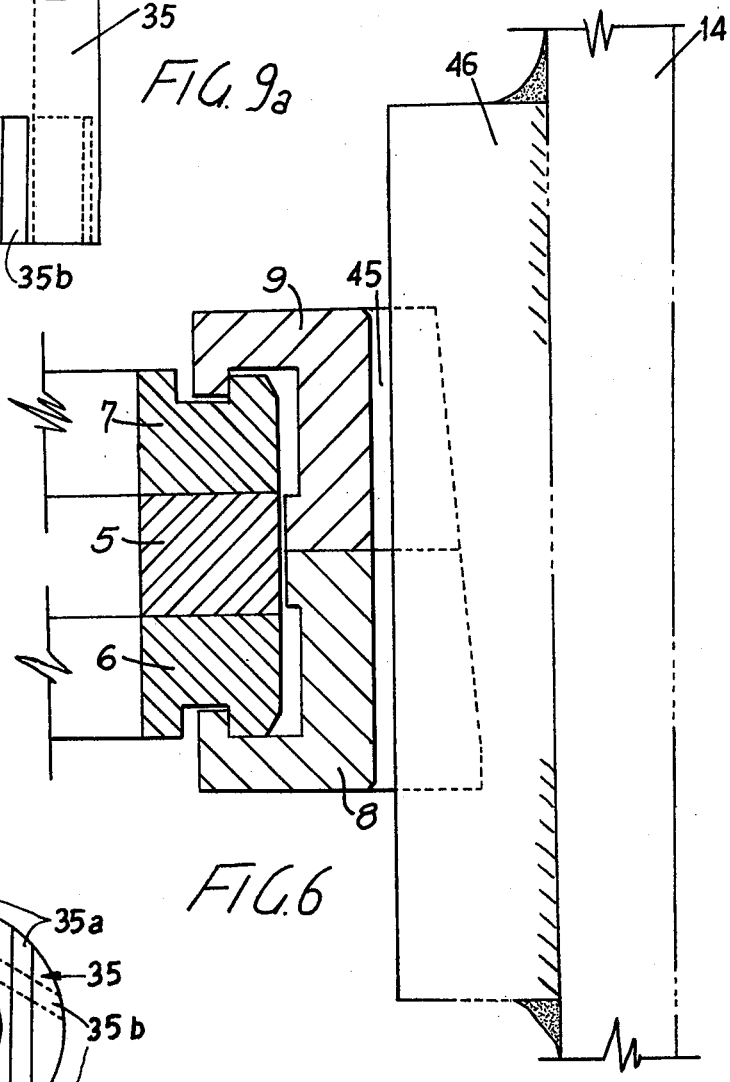
FIG. 6 is a sectional view taken along line VI—VI of FIG. 1.

A further expedient has also been provided for fastening each of the grids with respect to the housing. To this end, an antirotational key is mounted for securing the grid relative to the housing, as shown in FIGS. 1 and 6. At one or more locations of the grid frame, a milling or slot 45 has been provided for the passage of a key 46 which is welded to housing 14. It will be appreciated that a large radial play or clearance has been provided allowing a relative movement of the grid with respect to the housing in a radial direction, but not a relative rotation of these elements about the heat exchanger axis.

All of the foregoing description has been made with reference to a circular grid, but nothing would be altered should the grid be of a polygonal or semicircular shape.

What I claim is:

1. A supporting grid for pipes, comprising a reticular structure formed of a grid frame and strips made of a material different from that of the frame and having a manhole and associated reticular cover, wherein said manhole is approximately of isosceles trapezoid shape, the major base of which comprises a segment of the grid frame, the minor base a strip nearly parallel to the former, and the two sides comprise two strips, means securing said cover to the grid, said securing means including connecting means between the grid and cover for preventing tengential movement of the cover relative to the grid frame, preventing perpendicular movement of the cover relative to the plane of the grid, and enabling free expansion of the cover in a radial direction relative to the grid frame, said cover including a stiffening member secured thereto and being rigidly and releasably secured to the reticular structure of the grid, said stiffening member including two plates arranged on opposite surfaces of the reticular cover, said plates being secured to said reticular cover by means of axially bored bushings extending between the plates, a pin in each bushing welded to said plates, securing the latter to each other and to the reticular cover.

2. A grid according to claim 1, wherein said cover stiffening plates are arranged on the axis of symmetry for the cover, that is in a radial direction relative to the grid center.

3. A grid according to claim 2, wherein upon and under the reticular structure of the grid adjoining the cover side closest to the center of said grid two additional plates are provided and secured to each other and to the reticular structure of the grid by means of bushings having a central bore receiving a pin which is then welded to said plates, and wherein said connecting means between the grid and cover including a bracket rigid with the cover and bolts securing the bracket to said additional plates that are secured to the grid.

4. A grid according to claim 2, wherein the bushings for securing said pairs of plates comprise in addition to an axial bore also slots into which adjoining strips of the reticular structure can penetrate.

5. A grid according to claim 2, wherein the connecting means for the cover to the grid, preventing tangential movement relative to the frame includes a slit provided on a portion integral with the grid frame, said stiffening member extending radially into said slit, said slit being of the same size as the stiffening member in a direction tangential to the frame.

6. A supporting grid for pipes, comprising a reticular structure formed of a grid frame and strips made of a material different from that of the frame and having a manhole and associated reticular cover, wherein said manhole is approximately of isosceles trapezoid shape, the major base of which comprises a segment of the grid frame, the minor base a strip nearly parallel to the former, and the two sides comprise two strips, means securing said cover to the grid, said securing means including connecting means between the grid and cover for preventing tengential movement of the cover relative to the grid frame, preventing perpendicular movement of the cover relative to the plane of the grid, and enabling free expansion of the cover in a radial direction relative to the grid frame, said cover including a stiffening member secured thereto and being rigidly and releasably secured to the reticular structure of the grid, the connecting means for the cover to the grid, inhibiting any movements in a perpendicular direction to the plane of the grid, comprising at least one "Z"-shaped iron arranged on the grid frame so as to be spaced apart in a radial direction from the cover, but contacting the latter at the top thereof.

7. A grid according to claim 1, wherein said reticular grid cover includes intersecting strips at least some of which are riveted to one another.

8. A grid according to claim 7, wherein the intersecting strips to be riveted have at the ends thereof projecting tabs, said cover including peripheral strips penetrated by said tabs, said tabs being riveted over where they penetrate the peripheral strips.

9. In a reticular grid for supporting pipes in a heat exchanger in which the grid includes a peripheral frame and a plurality of intersecting strips connected with the frame, that improvement comprising a manhole formed in said reticular grid interiorly of said frame with a segment of the frame defining the outer edge of the manhole, and a reticular cover for said manhole to be placed in closing relation to the manhole when access through the grid is no longer necessary, said cover conforming generally to the configuration of the manhole, means rigidly connecting a portion of the cover to the strips forming the reticular grid, means connecting a portion of the cover to the grid frame segment defining the outer edge of the manhole to preclude relative tangential movement between the grid frame segment and the cover and to preclude lateral movement of the cover out of the plane of the grid and grid frame segment and to enable relative radial movement between the cover and grid frame segment, said reticular cover including a plurality of intersecting strips, and stiffening means connected with said cover strips and having ends extending beyond the periphery of the cover at opposite peripheral portions thereof, said connecting means between the cover and reticular grid being connected to one end of said stiffening means, the other end of said stiffening means being engaged by said connecting means between the grid frame segment and the cover, said stiffening means being in the form of a narrow plate extending generally along a central portion of the cover and into overlying relation to a central portion of the grid frame segment, a bracket secured to the grid frame segment, said bracket including a slot therethrough receiving the end of the narrow plate, said connecting means between the grid frame segment and cover also including a pair of brackets attached to the end portions of the grid frame segment and overlying the adjacent edge of the cover.

* * * * *